United States Patent [19]

Murakami et al.

[11] Patent Number: 4,559,470

[45] Date of Patent: Dec. 17, 1985

[54] FLUORESCENT DISCHARGE LAMP

[75] Inventors: Katsuo Murakami; Hitoshi Yamazaki; Norihiko Tanaka; Hiroshi Ito, all of Kamakura, Japan

[73] Assignee: Mitsubishi Denki Kabushiki Kaisha, Tokyo, Japan

[21] Appl. No.: 444,392

[22] PCT Filed: Apr. 21, 1982

[86] PCT No.: PCT/JP82/00134

§ 371 Date: Nov. 17, 1982

§ 102(e) Date: Nov. 17, 1982

[87] PCT Pub. No.: WO82/03726

PCT Pub. Date: Oct. 28, 1982

[30] Foreign Application Priority Data

Apr. 22, 1981 [JP] Japan ..... 56-60798

[51] Int. Cl.[4] ..... H01J 61/48

[52] U.S. Cl. ..... 313/487; 313/485

[58] Field of Search ..... 313/485, 486, 487; 428/690, 691; 427/67

[56] References Cited

U.S. PATENT DOCUMENTS 3,707,642 12/1972 Thornton ..... 313/486
4,038,204 7/1977 Wachtel ..... 252/301.4 P
4,199,708 4/1980 Lauwerijssen et al. ..... 313/612
4,431,941 2/1984 Roy et al. ..... 313/487

FOREIGN PATENT DOCUMENTS 33940 10/1973 Japan .
37670 11/1973 Japan .
1083 1/1974 Japan .
1084 1/1974 Japan .
32959 10/1975 Japan .

*Primary Examiner*—David K. Moore
*Attorney, Agent, or Firm*—Wenderoth, Lind & Ponack

[57] ABSTRACT

A fluorescent discharge lamp of improved light output having a plurality of phosphor layers stacked on a substrate of a glass tube so that the concentration of activator for the phosphor layer located near the glass substrate is less than that for the phosphor layer located at a position remote from the glass substrate, thereby to form phosphor layer having a low reflection factor to an ultraviolet ray on the electric discharge side, and a phosphor layer of enhanced quantum efficiency and high reflection factor to the ultraviolet ray on the side of the glass substrate. The ultraviolet ray generated with an electric discharge is caused to be absorbed as much as possible by the phosphor layers thereby to improve the light output. The lamp is used in, for example the field of illumination.

8 Claims, 2 Drawing Figures

FLUORESCENT DISCHARGE LAMP

TECHNICAL FIELD

This invention relates to a fluorescent discharge lamp having a plurality of phosphor layers.

BACKGROUND ART

As well known, a phosphor layer is provided on the inner surface of a glass tube for low pressure type fluorescent discharge lamps, and on the inner surface of an outer glass tube having a light emitting tube accommodated therein for the high pressure type lamps.

In fluorescent lamps which are representative of low pressure type fluorescent discharge lamps, a greater part of ultraviolet rays generated by means of an electric discharge of a mercury vapor is absorbed by the phosphor layer to be converted to light of a long wavelength. One part of the light passes through the phosphor layer to be absorbed by glass, resulting in a loss (an absorption loss), while another part thereof is relfected from the phosphor layer and absorbed by the electric discharge, resulting in a further loss (a reflection loss). Also, in the high pressure type fluorescent discharge lamps such as high pressure mercury fluorescent lamps, members exist for absorbing ultraviolet rays such as glass and the light emitting tube other than the fluorescent layer, to cause an absorbtion and a reflection loss such as described above.

In order to improve the light output from such fluorescent discharge lamps, it is desirable to decrease the absorption and reflection losses and absorb ultraviolet rays generated with electric discharges by the phosphor layer as much as possible. As a method of decreasing the absorption and reflection losses, it is known to stack a plurality of phosphor layers on a glass substrate in such a manner that the layer located nearest to the electric discharge side is composed of phosphor particles having a low reflection factor to ultraviolet rays. According to Japanese patent publication No. 32,959/1975 there is disclosed the fact that, upon stacking a plurality of phosphor layers having different reflection factors to ultraviolet rays, phosphor particles low in reflection factor to ultraviolet rays have a large mean particle diameter, while phosphors high in reflection factor to ultraviolet rays have a small mean particle diameter.

In order to constitute the phosphor layers in this way, it is necessary to separately provide a phosphor having a small mean particle diameter and that having a large mean particle diameter in substantially equal amounts, and also it is required that there is a large difference in mean particle diameter between the two. According to follow-up experiments of the inventors, however, a phosphor powder normally synthesized has a small proportion of particles having the large and small mean particle diameters required for such phosphor layers and when the powder is separated by means such as elutriation or the like, there is a large amount of undesirable particles having intermediate mean particle diameters. Discarding the undesirable particles is not considered in mass production systems, and therefore when an attempt is made to pulverize them by a grinder such as a ball mill. For use as particles of a small mean particle diameter, the destruction of the phosphor proceeds by means of the so-called pressure disruption in the pulverizing step to decrease the quantum yield (ratio of the number of emitting quanta to that of absorbed quanta, that is, a quantum yield upon conversion of a wavelength). This increases the loss in energy. Thus it has been found that, even if the phosphor layers were stacked into the abovementioned construction, the desired lamp efficiency is not obtained.

Thus, the present inventors have examined the provision of phosphors high in reflection factor to ultravoilet rays and also high in quantum yield, and it has been found that if the concentration of an activator is changed to adjust the reflection factor to ultraviolet rays, then the quantum yield can be improved.

This phenomenon will be described as follows:

Phosphors used with electric discharge lamps are, in many cases, composed of a matrix and activator. For example, in trivalent terbium activated yttrium silicate [$Y.Tb)_2SiO_5$] described in Japanese patent publication No. 37,670/1973, the yttrium silicate ($Y_2SiO_5$) is the matrix and the terbium (Tb) is an activator.

The Table below takes trivalent terbium activated yttrium silicate phosphor as an example and indicates changes in reflection factor to ultraviolet rays and quantum yield (relative value) when the concentration of the activator, terbium (Tb), is changed. This phosphor provides the highest luminescence output with ultraviolet excitation when it includes 0.16 gram atom of terbium (Tb) with respect to substantially 0.84 gram atom of yttrium. Thus for use with electric discharge lamps, this concentration of the activator is normally adopted. In a Table, Nos. 1 to 5 have the mean particle diameter (10 microns) on the order of that normally used, and are merely changed in concentration of the activator, terbium (Tb). No. 6 has the same concentration of the activator as No. 5 but has the mean particle diameter decreased to 2.7 microns by means of a grinder such as a ball mill or the like. As shown in the Table, a reduction in concentration of the activator causes an increase in reflection factor to an ultraviolet ray (a decrease in amount of absorption of the ultraviolet ray) and improvement in quantum yield. Furthermore, by comparing No. 1 and No. 6 having the same reflection factors to the ultraviolet ray, it is found that a far more advantageous quantum yield is obtained when the reflection factor is adjusted by changing the concentration of the activator, than when it is done by changing the mean particle diameter through the pulverization.

TABLE

| NO | Composition of Phosphor | Mean Particle Diameter (microns) | Reflection Factor to Ultraviolet Ray (254nm) | Relative Luminescence Output (%) | Relative Quantum Efficiency |
|---|---|---|---|---|---|
| 1 | $(Y0.96Tb0.04)_2SiO_5$ | 10 | 0.40 | 74 | 1.00 |
| 2 | $(Y0.93Tb0.07)_2SiO_5$ | 10 | 0.25 | 91 | 0.98 |
| 3 | $(Y0.90Tb0.10)_2SiO_5$ | 10 | 0.19 | 97 | 0.97 |
| 4 | $(Y0.87Tb0.13)_2SiO_5$ | 10 | 0.15 | 99 | 0.94 |
| 5 | $(Y0.84Tb0.16)_2SiO_5$ | 10 | 0.13 | 100 | 0.93 |
| 6 | $(Y0.84Tb0.16)_2SiO_5$ | 2.7 | 0.40 | 67 | 0.91 |

In this Table the reflection factor to the ultraviolet ray designated its value when MgO is made 1.00.

DISCLOSURE OF THE INVENTION

The present invention provides a fluorescent discharge lamp in which phosphor to be excited with an ultraviolet ray so as to emit light, is disposed in a plurality of layers on a glass substrate so that the phosphor layers having a high reflection factor to the ultraviolet ray are located on the side of the glass substrate, and the phosphor layers having a low reflection factor to the ultraviolet ray are located on the side of an electric discharge, which the concentration of an activator for the phosphor is successively increased starting with that phosphor layer located nearest to the glass substrate and moving toward the phosphor layer on the electric discharge side, thereby to improve light output.

BEST MODE FOR CARRYING OUT THE INVENTION

Figure 1:
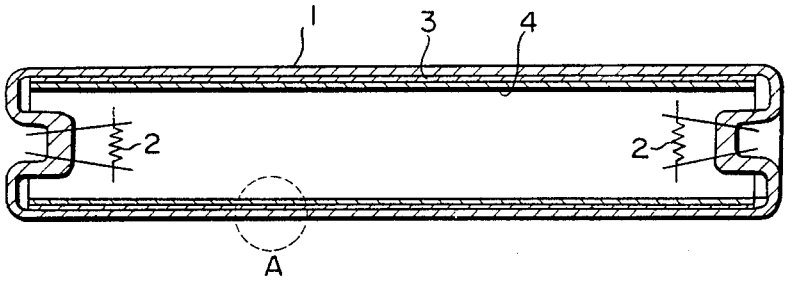
FIG. 1 is a longitudinal sectional view of a fluorescent lamp illustrating one embodiment of the present invention.
Figure 2:
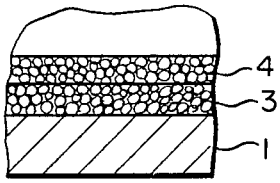
FIG. 2 is an enlarged view of part A in FIG. 1.

FIG. 1 is a schematic longitudinal sectional view of the fluorescent lamp of the present invention wherein (1) is a glass tube and (2) is an electrode sealed through either end thereof, the space within the glass tube being charged with mercury and at least one rare gas. Stacked on the inner surface of the glass tube (1) are two phosphor layers (3) and (4) composed of a phosphor having a different concentration of an activator respectively so that one (3) of the phosphor layers is at a position near to the inner surface of the glass tube, and the other phosphor layer (4) is at a position on the side of an electric discharge. Here the phosphor of the phosphor layer (3) has a low concentration of the activator as compared with that of the other phosphor layer (4), and therefore has a reflection factor to an ultraviolet ray higher than that of the other phosphor layer (4). Upon the application of a voltage across the electrodes, an electric discharge occurs in the space within the glass tube to generate an ultraviolet ray principally at a wavelength of 254 nm. This stimulates the phosphor layers (3) and (4) to produce a light ray having a longer wavelength.

The optical operation of the lamp having the phosphor layers (3) and (4) thus formed will be outlined. A greater part of the ultraviolet ray is first absorbed by the phosphor layer (4) located at its position remote from the glass tube (1) and having a low reflection factor to the ultraviolet ray, and is converted to light of a long wavelength. A part of the ultraviolet ray which is not absorbed by that phosphor layer (4), and a part of the ultraviolet ray which passes through this layer (4) to reach the phosphor layer (3) having a high reflection factor to the ultraviolet ray and disposed at the position near to the glass tube (1), is converted to light of a long wavelength by the phosphor layer (3) having a high quantum efficiency with a high conversion efficiency. Also a part is again reflected back to the phosphor layer (4) where it is converted to light of a long wavelength. By disposing the phosphor layer (4) low in reflection factor to the ultraviolet ray on the discharge side, and the phosphor layer (3) high in reflection factor to the ultraviolet ray and having enhanced quantum efficiency on the side of the glass substrate, the absorption loss and reflection loss are decreased, and also the loss in energy upon the conversion of the wavelength of light by the phosphor is decreased.

The formation of the phosphor layers (3) and (4) by stacking in the present invention can be carried out by a conventional process such as mixing each phosphor with butyl acetate or another solvent along with a binder such as nitrocellulose, coating the inner surface with a suspension and removing the binder by dry heating. Also the heating step of removing the binder may be interposed between the steps of forming the layer (3) and the layer (4) (the formation of the layer (3)→heating→the formation of the layer (4)→heating). Alternatively, it may be executed only once after the stacking of the layer (4) on the layer (3) (the formation of the layer (3)→the formation of the layer (4)→heating).

More than two phosphor layers may be stacked. In this case the concentration of the activator is successively increased starting with the layer located at the position nearest to the glass substrate.

Concrete Examples of the present invention will be described hereinafter.

EXAMPLE 1

Upon manufacturing a 40 watt fluorescent lamp, a yttrium silicate phosphor $(Y0.96Tb0.04)_2SiO_5$ of the mean particle diameter of 10μ having a low concentration of an activator was used to form the phosphor layer (3) on the inner surface of a glass tube in an attached amount of 2.8 mg/cm$^2$, and then a yttrium silicate phosphor $(Y0.84Tb0.16)_2SiO_5$ of the mean particle diameter of 10μ having a high concentration of the activator was used to form the phosphor layer (4) thereon in an attached amount of 2.4 g/cm$^2$, to produce a fluorescent lamp having a maximum luminescence at 543 nm and emitting green light. The light output had a luminous flux of 5200 lumens. For comparison purposes the yttrium silicate phosphor $(0.84Tb0.16)_2SiO_5$ of the mean particle diameter of 10μ having said high concentration of the activator was used to form a phosphor layer consisting of a single layer in an attached amount of 5.2 mg/cm$^2$ into a 40 watt fluorescent lamp having a luminous flux of 4990 lumens, which is about 4% less than that of the above lamp. Also for comparison there was formed on the inner surface of a glass tube a phosphor layer of yttrium silicate phosphor (Y0.84Tb0.16) having a high concentration of the activator by reducing the mean particle diameter to 2.7 microns through pulverization, in an attached amount of 1.7 mg/cm$^2$, and then a phosphor layer was formed thereon of yttrium silicate phosphor $(Y0.84Tb0.16)_2SiO_3$ of the mean particle diameter of 10μ having a high concentration of the activator, in an attached amount of 2.4 mg/cm$^2$. The resulting 40 watt fluorescent lamp had a luminous flux of 4950 lumens, which is about 5% less than that of the above lamp of the present invention.

EXAMPLE 2

In order to provide a fluorescent lamp simultaneously having a high efficiency and a high color rendering property by concentrating luminescence in a range of wavelengths of blue, green and red such as disclosed, for example, in Japanese patent publication No. 22,117/1973, the undermentioned phosphor mixtures (1) and (2) were prepared.

(1) A mixture of phosphors having low concentrations of activators

| | |
|---|---|
| trivalent europium activated yttrium oxide phosphor $(Y0.985Eu0.015)_2O_3$ | 33% by weight |
| trivalent terbium activated yttrium | 57% by weight |

-continued

| | |
|---|---|
| silicate phosphor $(Y0.96Tb0.04)_2SiO_5$ | |
| bivalent europium activated strontium-barium chlorophosphate phosphor $Sr7.00Ba2.97Eu0.03(PO_4)_6Cl_2$ | 10% by weight |

(2) A mixture of phosphors having high concentrations of activators.

| | |
|---|---|
| trivalent europium activated yttrium oxide phosphor $(Y0.947Eu0.053)_2O_3$ | 34% by weight |
| trivalent terbium activated yttrium silicate phosphor $(Y0.84Tb0.16)_2SiO_5$ | 58% by weight |
| bivalent europium activated strontium chlorophosphate phosphor $Sr7.00Ba2.88Eu0.12(PO_4)_6Cl_2$ | 8% by weight |

Mixing ratios of the two mixtures are adjusted respectively so that luminescent colors are substantially equal to one another and white light at a temperature of 4200° K. is obtained. Also the two mixtures have the mean particle diameter of about 7 microns. The mixture (1) was used to first form the phosphor layers (3) on the inner surface of a glass tube in an attached amount of 2.5 mg/cm$^2$, and the mixture (2) was used to form the phosphor layer (4) thereon in an attached amount of 2.5 mg/cm$^2$ to produce a 40 watt fluorescent lamp. The luminous flux of the lamp is 3800 lumens, which is an improvement of 4% as compared with 3650 lumens of a lamp consisting of a single layer having an attached amount of 4.8 mg/cm$^2$ by using only the mixture (2) for comparison purpose. There is also an improvement of 5% as compared with 3610 lumens of a lamp having formed thereon a phosphor layer in an attached amount of 5 mg/cm$^2$ by using a mixture of mean particle diameter of 2.0 microns provided through pulverization of the mixture (2), and stacked thereon a phosphor layer in an attached amount of 2.3 mg/cm$^2$ by using the mixture (3) without pulverization.

EXAMPLE 3

The mixture (1) described in Example 2 was pulverized to make the mean particle diameter 2.0 microns and used to form the phosphor layer (3) in an attached amount of 1.2 mg/cm$^2$ on the inner surface of a glass tube, and the mixture (2) with mean particle diameter of 7 microns described in Example 2 was used without pulverization to form the phosphor layer (4) in an attached amount of 2.5 mg/cm$^2$ thereon to produce a 40 watt fluorescent lamp. The luminous flux of the lamp is 3720 lumens, about 2 to 3% improvement over the comparison lamps described in Example 2.

As described in Example 3, the effect of the present invention is obtained even in the presence of a difference in mean particle diameter between the phosphor layers (3) and (4). That is to say, while the effect of improvement of a light output decreases by a decrease in quantum efficiency due to the pulverization, there still exists an improvement of the quantum efficiency due to a decrease in concentration of the activator, so that the effect of improvement of the light output is yet maintained. And in this case, against some sacrifice of the effect of improvement of the light output, the weight of the attached phosphor is reduced, originating from the decrease in mean particle diameter, resulting in the effect to saving of the phosphors.

The present invention is applicable to electric discharge lamps using phosphors of a reflection factor to an ultraviolet ray (excited light) which varies with concentrations of activators other than those described above, and is also applicable to the use of a phosphor including two types of the activator. For example in a green luminescent phosphor having trivalent cerium (Ce) and trivalent terbium (Tb) as activators, and lanthanum phosphate, magnesium borate, yttrium silicate or the like as a matrix, cerium absorbs an ultraviolet ray and transmits its energy to terbium to enhance the green luminescence of terbium. (In this case, the cerium may also be called a sensitizer.) In such a case, however, the reflection factor to the ultraviolet ray may be changed by adjusting the concentration of the cerium. Also, the concentrations of the cerium and terbium may be adjusted. In the latter method, if the ratio of the concentration of the cerium to that of the terbium is not suitable, then the transmission of energy from the cerium to the terbium is not perfect, and the luminescence resulting from the cerium, which lies in a range of ultraviolet through blue wavelengths, becomes enhanced, to decrease the quantum efficiency concerning the desired green luminescence resulting from the terbium. Thus it is desirable to adjust the concentration ratio of the cerium to the terbium so as not to cause such a phenomenon.

From the foregoing description it is apparent that, with the use of mixed phosphors such as described in Example 2 upon carrying out the present inventon, desired effect is obtained even with the adjustment of the activator's concentration(s) for a specified phosphor(s) alone among a plurality of phosphors.

From the foregoing description it is understood that the present invention may be carried out with other types of electric discharge lamps such as high pressure type fluorescent discharge lamps, for example, fluorescent high pressure mercury lamps or fluorescent lamps comprising a member for controlling an electric discharge path therein.

We claim:

1. A fluorescent discharge lamp comprising a glass tube for surrounding a source of ultraviolet rays, and a plurality of successive phosphor layers coated on the inner surface of said glass tube, each of said phosphor layers containing a phosphor having a matrix and an activator in said matrix, wherein the concentration of said activator in the respective phosphor layers increases with increasing remoteness of said phosphor layer from said inner surface of said glass tube, the phosphors in each phosphor layer having the same components and the same activator, differing in the proportion of the activator in the respective phosphors.

2. A fluorescent discharge lamp according to claim 1, wherein said phosphor has substantially the same mean particle diameter among said phosphor layers.

3. A fluorescent discharge lamp according to claim 2, wherein said activator includes a member selected from the group consisting of trivalent europium, trivalent terbium, trivalent cerium and bivalent europium.

4. A fluorescent discharge lamp according to claim 1, wherein the mean particle diameter of said phosphor increases with increasing remoteness of said phosphor layer from said inner surface of said glass tube.

5. A fluorescent discharge lamp according to claim 4, wherein said activator includes a member selected from the group consisting of trivalent europium, trivalent terbium, trivalent cerium bivalent europium.

6. A fluorescent discharge lamp according to claim 1, wherein said activator includes a member selected from the group consisting of trivalent europium, trivalent terbium, trivalent cerium and bivalent europium.

7. A fluorescent discharge lamp according to claim 6, wherein each phosphor layer includes at least one member selected from the group consisting of a trivalent europium activated yttrium oxide phosphor, a trivalent terbium activated yttrium silicate phosphor, a trivalent cerium-trivalent terbium coactivated lanthanum phosphate phosphor, a trivalent cerium-trivalent terbium coactivated magnesium borate phosphor, a trivalent cerium-trivalent terbium coactivated yttrium silicate phosphor, and a bivalent europium activated strontium-barium chlorophosphate phosphor.

8. A fluorescent discharge lamp according to claim 1, wherein each phosphor layer includes at least one member selected from the group consisting of a trivalent europium activated yttrium oxide phosphor, a trivalent terbium activated yttrium silicate phosphor, a trivalent cerium-trivalent terbium coactivated lanthanum phosphate phosphor, a trivalent cerium-trivalent terbium coactivated magnesium borate phosphor, a trivalent cerium-trivalent terbium coactivated yttrium silicate phosphor, and a bivalent europium activated strontium-barium chlorophosphate phosphor.

* * * * *